United States Patent [19]

Richardson

[11] 4,239,432

[45] Dec. 16, 1980

[54] ARTICLE HANDLING APPARATUS CAPABLE OF REVERSIBLY LOADING AND UNLOADING ARTICLES IN PREDETERMINED ROWS

[75] Inventor: Raymond Richardson, Englewood, Colo.

[73] Assignee: Nolan Systems Inc., Denver, Colo.

[21] Appl. No.: 20,185

[22] Filed: Mar. 13, 1979

[51] Int. Cl.[3] ..... B65H 31/30

[52] U.S. Cl. ..... 414/110; 414/45; 414/47; 414/68; 414/97; 414/416; 53/534; 53/535

[58] Field of Search ..... 414/35, 37, 45, 47, 414/68, 69, 82, 97, 98, 110, 391, 399, 417, 422, 589, 591, 416; 53/534, 535, 537; 108/55.1, 55.3; 211/50

[56] References Cited

U.S. PATENT DOCUMENTS

| | | | |
|---|---|---|---|
| 2,703,182 | 3/1955 | Broberg et al. | 414/98 X |
| 3,116,579 | 1/1964 | Carter | 53/534 |
| 3,126,105 | 3/1964 | Marguet | 414/35 X |
| 3,831,782 | 8/1974 | Werntz | 414/110 X |
| 3,880,308 | 4/1975 | Stobb | 414/110 X |
| 4,043,459 | 8/1977 | Moreau | 414/82 X |

FOREIGN PATENT DOCUMENTS

| | | | |
|---|---|---|---|
| 525862 | 6/1956 | Canada | 414/97 |

*Primary Examiner*—L. J. Paperner
*Attorney, Agent, or Firm*—Gary M. Polumbus

[57] ABSTRACT

Randomly spaced articles in serial order are separated into predetermined linear configurations or rows of a predetermined number of articles and thereafter simultaneously transferred into compartments in rows in a container. In reverse operation, articles from the compartments in the container are transferred into single file order. The apparatus used in these operations includes a conveyor upon which the predetermined linear configuration of articles is established, and a conveyor which moves the container and its rows of compartments into alignment to receive the articles, and an elevator assembly for transferring the articles in the predetermined configuration between the first conveyor and the rows of the container. Separably operable conveyor segments and separator plates establish the predetermined linear configuration on the conveyor, and the conveyor moves to avoid interference with the movement path of the articles transferred by the elevator assembly.

22 Claims, 8 Drawing Figures

ARTICLE HANDLING APPARATUS CAPABLE OF REVERSIBLY LOADING AND UNLOADING ARTICLES IN PREDETERMINED ROWS

BACKGROUND OF THE INVENTION

1. Field of the Invention

The present invention relates to the handling and disposition of articles, and more particularly to an apparatus capable of reverse operation for loading articles into rows of a container or unloading previously loaded articles from rows of a container. The present invention is particularly useful in newspaper production situations where stacks of newspapers, generally referred to as pre-prints, are produced prior to final assembly into the newspaper.

2. Introduction and Brief Description of Prior Art

In newspaper production operations, it is typical to print pre-prints in advance of the time at which the newspaper is produced. For example, inserts are typically included in many Sunday newspapers. These inserts or pre-prints are generally printed days in advance of the time the Sunday newspaper is printed. The pre-prints are accurately counted into predetermined sizes of stacks and thereafter hand loaded on skids or special pallets and moved to a storage area by a manually operated load carrying vehicle. The pre-prints remain in storage until such time as the final newspaper assembly is started. The pre-printed sections are then manually transported from the storage area and either unloaded by hand onto a conveyor where the sections are hand stuffed into the final newspapers, or are unloaded by hand into a machine which automatically combines the pre-prints and the sections of the final newspaper. Such an arrangement has the disadvantages that an extra number of assistants must be employed to handle the pre-prints and that the use of storage space and manual production techniques increase the cost of the newspaper.

A variety of different conveying systems and arrangements are known in the art. Some of these systems and arrangements are represented by U.S. Pat. Nos. 2,703,182; 2,703,653; 3,045,801; 3,094,225; and 3,096,891. Some of the conveying systems represented by the cited patents relate to arranging articles in a suitable manner to be palletized. The articles are arranged in a configuration defining one horizontal layer, and a number of horizontal layers are vertically stacked on top of one another to form a desired configuration on the pallet. Frequently, the article configuration within each horizontal layer is varied to provide stability to the articles on the pallet. Other concepts such as conveying and operating on a single article at a time are illustrated by the cited prior art.

Other techniques, concepts and limitations in the prior art are known. Those skilled in the art will recognize various desirable aspects of the present invention, but comprehension of the desirable aspects of this invention should not diminish the significance of limitations in the prior art.

SUMMARY OF THE INVENTION

The present invention provides a new and improved apparatus for handling articles in which randomly spaced articles in single file order are transferred into predetermined pluralities of articles aligned in a predetermined configuration to compartments of a container. According to certain broad aspects of the invention, the predetermined number of articles is received and separated into the predetermined configuration, the articles are positioned at intervals which coincide with the intervals at which compartments in the container are spaced. An elevator means simultaneously transfers the predetermined configuration of articles vertically from the conveyor means into the compartments of the container. Another conveyor means indexes or moves the container into proper position for receiving the articles in the compartments. After the container has been filled with articles, the loaded container is moved to a storage area where further automated storage and use functions can be achieved. Randomly ordered single file stacks of newspapers are thus quickly and automatically arranged into the predetermined configuration and deposited into the compartments of the container. In the compartments, the newspapers are held securely and are in convenient for ready access. The compartments of the container are efficiently filled and the containers are thereafter automatically transported. The arrangement more efficiently and effectively handles, transports, and stores the articles of stacks of newspapers.

According to another aspect of the invention, the elements of the article handling apparatus are capable of reverse operation in which the articles in each row of compartments in the container are transferred to a conveyor. The articles in the container are unloaded and arranged in single file order ready to be used. The reverse operation allows for automated unloading of the containers with efficiency and effectiveness comparable to the loading operation.

A more complete understanding of the invention, as well as its significant advantages and features, can be obtained from the following detailed description of a preferred embodiment taken in conjunction with drawings briefly described below.

DETAILED DESCRIPTION OF PREFERRED EMBODIMENT

Figure 1:
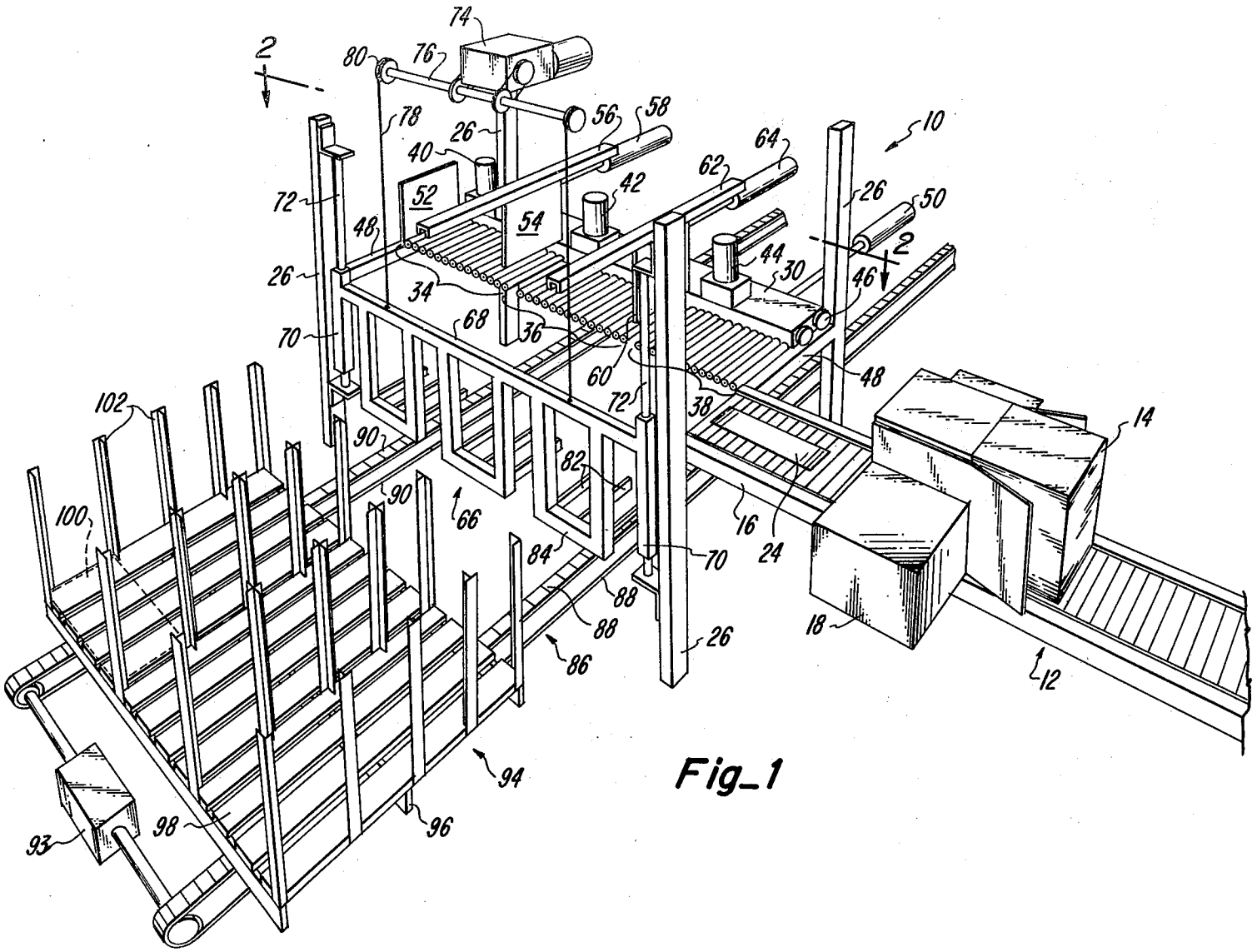
FIG. 1 is a perspective view of the article handling apparatus of the present invention illustrating the major elements of the apparatus in various positions.

The article handling apparatus 10 of the present invention is generally introduced by reference to FIG. 1. The basic elements of the apparatus 10 include a feed conveyor 12, an intermediate conveyor 28, at least one article separator plate 54 or 60, an elevator assembly 66, a transverse conveyor 86, and a container 94. The structure and operation of these basic elements and others are discussed separately below.

Structure

A first or feed conveyor 12, shown in FIGS. 1–4, carries and delivers of articles, such as stacks 14 of newspapers, in randomly spaced apart single file order. The articles are supplied to the feed conveyor 12 by conventional equipment, and in the case of newspapers, the stacks 14 are supplied to the conveyor 12 after they have been printed and accurately counted into predetermined sizes of stacks 14 by conventional newspaper production equipment. Near a terminal end 16 of the first conveyor 12, pacer means 18 are positioned. The pacer 18 is a conventional item having a pair of transversely spaced apart plates 20 and 22 which are selectively controllabe to compress against the sides of the stacks 14. The pacer 18 also includes sensor means such as a photo-electric sensor (not shown) to detect the presence of stacks 14 between the plates 20 and 22. Upon the presence of a stack, the pair of plates 20 and 22 is compressed against the sides of the stack to restrain movement of that stack and the others behind it on the feed conveyor 12, and also to straighten the restrained stack. When the plates 20 and 22 are released one stack 14 moves off the terminal end 16 of the feed conveyor 12. After the passage of one stack, the plates 18 and 20 compress against the next following stack to hold it until it is to be released. The pacer thus aligns and spaces the stacks as they move off the end 16 of the feed conveyor. A speed-up conveyor 24 is positioned intermediate the pacer 18 and the terminal end 16 of the feed conveyor 12. The speed-up conveyor 24 accelerates the movement of the stacks after they are released by the plates 20 and 22 of the pacer. Details of exemplary pacers 18 are more fully disclosed in the U.S. Pat. Nos. 3,189,156 and 2,986,262.

The stack handling apparatus 10 includes a main structural frame 26, part of which is shown in FIG. 1. The terminal end 16 of the feed conveyor 12 is attached to the structural frame 26 at an elevated position. The first conveyor 12 and the pacer 18 are conventionally supported.

A second or intermediate conveyor means 28 is operably attached to the structural frame 26 of the apparatus 10 and receives stacks delivered by the feed conveyor 12. The intermediate conveyor 28, shown best in FIGS. 1, 2, and 4, includes an intermediate conveyor frame 30 to which a plurality of spaced apart conveyor rolls 32 are attached. The conveyor rolls 32 are rotationally attached in a cantilever fashion from the conveyor frame 30 and collectively define an aligned intermediate conveying path. The intermediate conveying path is divided into a plurality of conveyor segments, and each conveying segment includes a plurality of conveyor rolls. Each conveyor segment is of size adapted to receive and support one stack 14 thereon. In the present embodiment a terminal conveyor segment 34, a middle conveyor segment 36 and an initial conveyor segment 38 are provided. The conveyor rolls of each conveyor segment are operably connected together for simultaneous rotation, and motor and drive means 40, 42, and 44 separably rotate the conveyor rolls of each conveyor segment 34, 36, and 38, respectively. The motor and drive means 40, 42 and 44 are connected to the intermediate conveyor frame 30.

The intermediate conveyor 28 is attached to the main structural frame 26 for operable transverse or horizontal reciprocating movement. Rollers 46 connected at each end of the intermediate conveyor frame 30 ride on rails 48 which form a part of the main structural frame 26. The intermediate conveyor 28 is thus movable between a retracted position, shown in FIGS. 1 and 4 (dotted lines), and a projected position illustrated in FIGS. 2 and 4 (solid lines). In the projected position, the intermediate conveying path defined by the conveyor segments 34, 36, and 38 is in alignment with the terminal end 16 of the first conveyor 12 to receive stacks 14. Typically the length of each of the conveyor rolls 32 is slightly greater than the transverse width of a stack 14. In the retracted position, the free ends of the conveyor rolls 32 are withdrawn at least the transverse width of and preferably greater than the transverse width of an article 14. Thus in the retracted position, the intermediate conveying path is not in alignment to receive articles delivered from the terminal end of the first conveyor. To move the intermediate conveyor to the projected position, activation means in the form of a conventional hydraulic cylinder and piston assembly 50 is provided. The assembly 50 is operatively connected between the intermediate conveyor frame 30 and the main structural frame 26 to effect movement between the retracted and projected positions. Sensing means such as position sensing switches (not shown) signal the intermediate conveyor attaining either its projected or retracted position.

Figure 2:
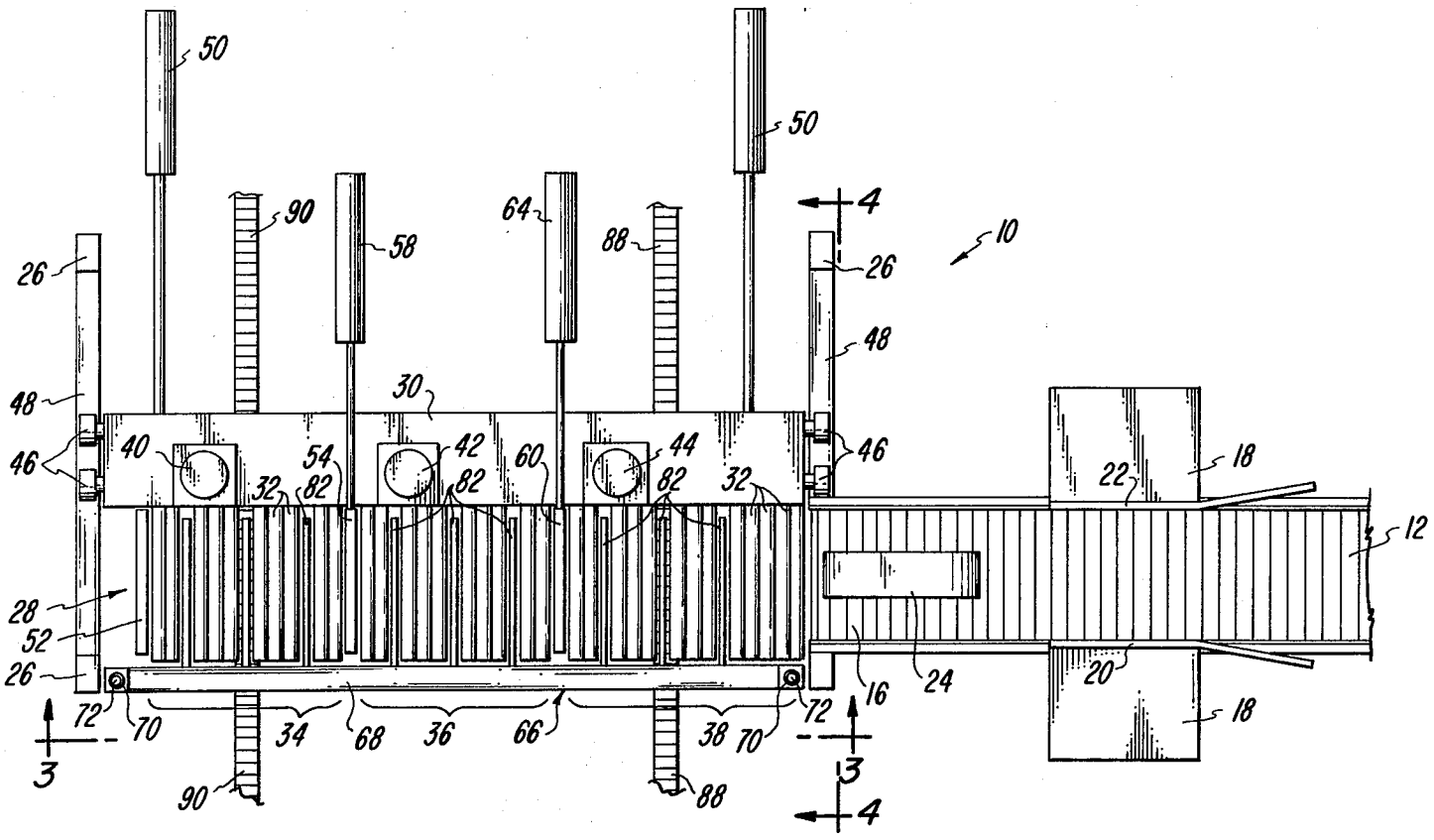
FIG. 2 is a top view viewed substantially from the plane of line 2—2 illustrating an intermediate conveyor and separator plates of the article handling apparatus in different positions than illustrated in FIG. 1.
Figure 3:
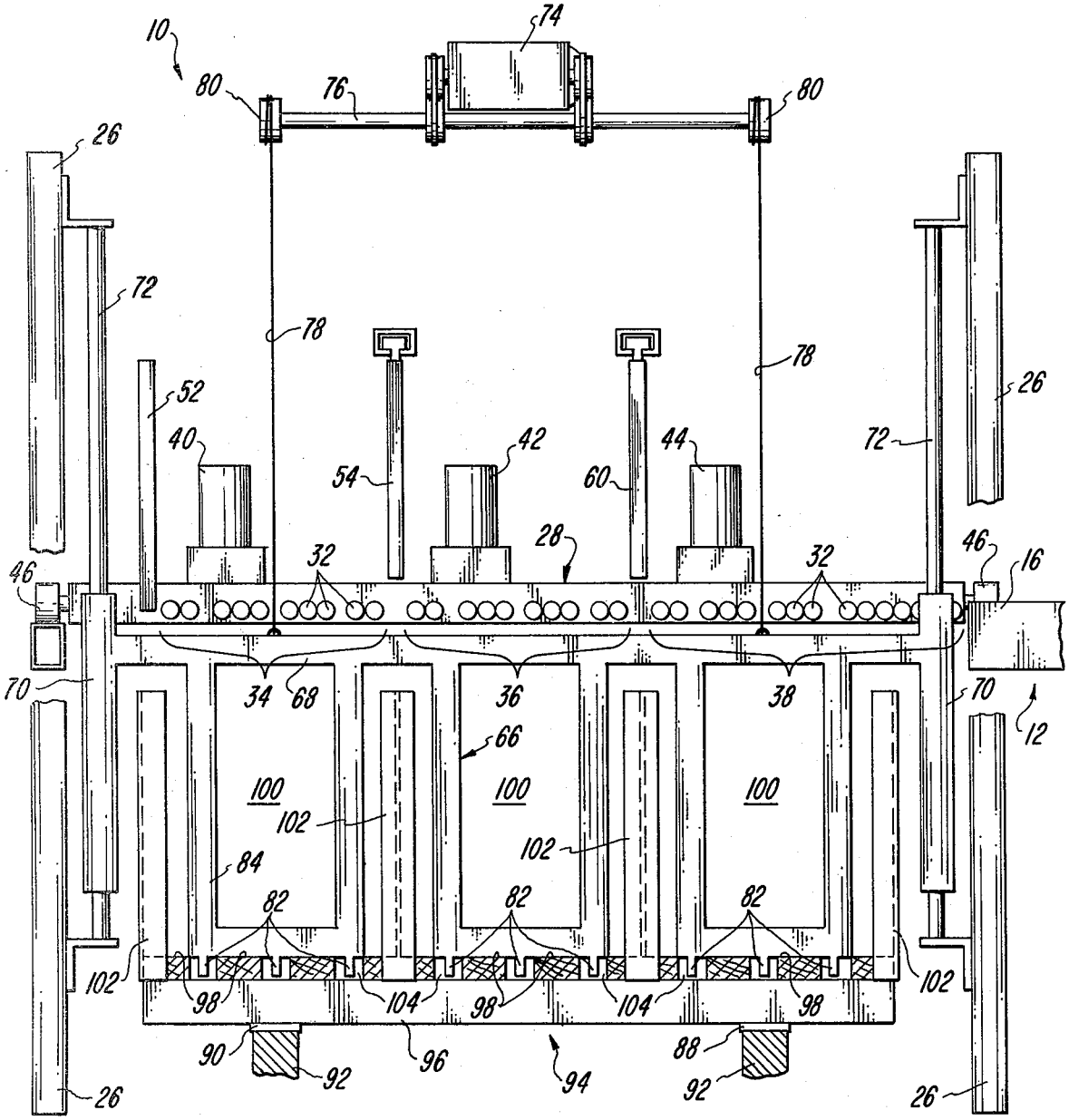
FIG. 3 is an elevational view viewed substantially from the plane of line 3—3 of FIG. 2.

A plurality of plate members are positioned at the terminal end of each of the conveyor segments 34, 36, and 38. An end plate member 52 is connected to the intermediate conveyor frame 30, and is always maintained in alignment with the terminal conveyor segment 34. A movable separator plate 54 is provided at the terminal end of the middle conveyor segment 36, i.e., between conveyor segments 34 and 36. The separator plate 54 is transversely movably suspended from a track 56, and the track 56 is attached to the main structural frame 26. Conventional attachment means connects the separator plate 54 to the track 56 so that it may move between a retracted position as shown in FIG. 1 and an extended position as shown in FIG. 2. A conventional hydraulic cylinder and piston assembly 58 is operatively connected to move the separator between its retracted and extended positions. Movement sensing switches (not shown) are associated with the track 56 to signal attainment of the retracted and extended positions. Movement of the separator plate 54 between its retracted and extended positions occurs independently of movement of the intermediate conveyor. The arrangement of elements on the intermediate conveyor frame 30 and the downward extent of the separator plate avoid any interference between the separator plate 54 and the intermediate conveyor 28 during relative movement.

The extended and retracted positions of the separator plate 54 are defined with respect to the intermediate conveying path when the intermediate conveyor 28 is in its projected position. In the retracted position, the separator plate 54 allows free passage of the stacks along the intermediate conveying path. In the extended position, the separator plate 54 blocks the intermediate conveying path and restrains movement of the stacks therealong.

In the apparatus 10, two separator plates are provided, the second separator plate being referenced 60. The separator plate 60 is suspended from a track 62 and is connected for movement between retracted and extended positions. Conventional hydraulic cylinder and piston assembly 64 moves the separator plate between the retracted and extended positions. In these respects the construction and operation of the elements associated with the second separator plate 60 are the same as that of the separator plate 54.

Sensor means such as contact switches (not shown) are operatively associated with each of the plate members 52, 54, and 56. The contact and restraint of movement of a stack over the intermediate conveying path is sensed when the plate members are positioned to block the movement of articles over the intermediate conveying path.

Figure 4:
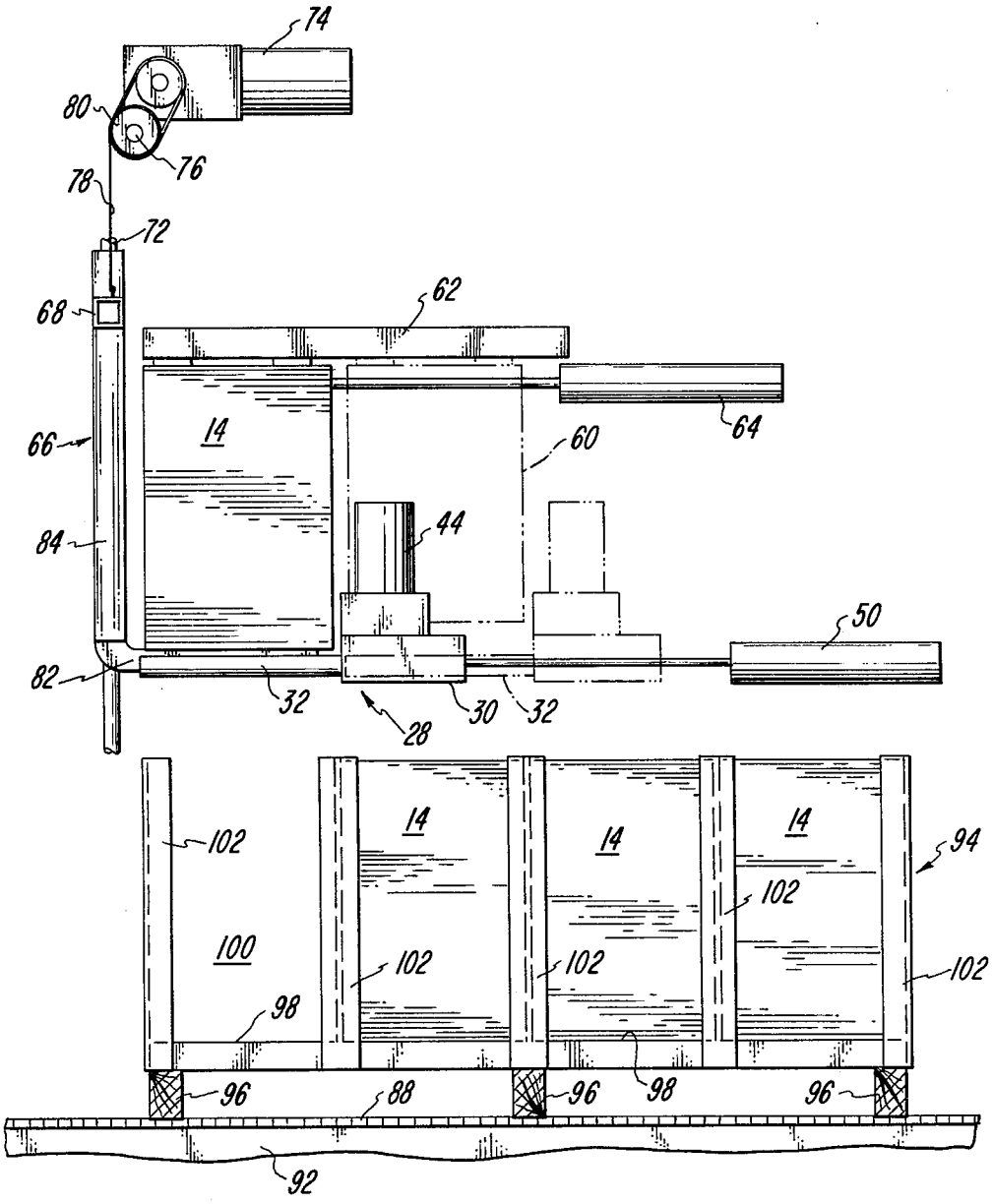
FIG. 4 is an elevational view viewed substantially from the plane of line 4—4 of FIG. 2, in which an elevator assembly is positioned at its upper position, an article or stack is supported by the elevator assembly, and a row of compartments in a container is vertically aligned below the stacks.

An elevator assembly 66 is operably connected to the main structural frame 26 to transfer stacks 14 from the intermediate conveying path. An elevator frame member 68 extends parallel to the intermediate conveying path and in spaced relation with the free ends of the conveyor rolls. Sleeve members 70 attached at ends of the frame member 68 slide along vertically disposed rods 72 attached to the main structural frame 26. Vertical movement of the elevator assembly between a lower position, shown in FIGS. 1 and 3, and an upper position, shown in FIG. 4, is achieved by conventional motor and drive means 74 attached to the main structural frame 26. The motor and drive means 74 is operatively connected to rotate a drive shaft 76. Chains 78 and sprockets 80 cause the rotational movement of the drive shaft 76 to move the elevator assembly between its upper and lower positions. Sensor means (not shown) are arranged to sense the attainment of the upper and lower positions of the elevator assembly 66.

A plurality of tines 82 are connected to extend horizontally from U-shaped portions 84 of the elevator frame member 68 in the direction of the intermediate conveyor 28. The tines 82 extend parallel to one another and to the conveyor rolls 32 of the intermediate conveyor and are positioned in vertical alignment with some of the spaces between the conveyor rolls 32 in each conveyor segment. Thus, the elevator assembly 66 is freely movable between the upper and lower positions when the intermediate conveyor 28 is in either its retracted or projected position. The horizontal extent of the tines is preferably sufficient to encompass the width of the intermediate conveying path (FIG. 2). The upper surfaces of the tines 82 generally fall within and define a plane (FIG. 4), parallel to the conveying plane of the intermediate conveying path. When the elevator assembly 66 occupies its upper position, the plane defined by the upper surface of the tines is slightly above the plane of the intermediate conveying path defined by the conveyor rolls 32.

A third or transverse conveyor means 86 extends underneath the intermediate conveyor 28 and transversely with respect to the intermediate conveying path, as shown in FIGS. 1–4. The transverse conveyor 86 includes two chains 88 and 90 supported by conventional support means 92. Conventional conveyor drive means 93 is operatively connected for moving or indexing the chains 88 and 90 along the paths which the chains extend.

A container 94 for receiving the stacks 14 is supported in a predetermined position on and carried by the transverse conveyor 86, as shown in FIGS. 1–4. The container 94 includes a support base 96 and means defining a generally planar upper surface 98. The upper surface 98 is divided into a plurality of compartments 100 by means of partitioning elements 102 extending upward from the surface 98. The partitioning elements 102 divide the supporting surface 98 into rows of compartments, with each row extending generally transversely of the transverse conveyor 86 and parallel with the intermediate conveyor 28. Each row contains the same predetermined plurality of compartments 100. Each exemplary container 94 includes four rows of compartments with three compartments forming each row. Each of the compartments 100 is of a size to closely receive therein one stack 14. Each partitioning element 102 includes at least two right angle support walls which define each corner of the compartment 100. The support walls of the elements 102 maintain the stability of the untied newspapers in the stacks during movement and processing of the containers. A plurality of slots 104 are formed into the support surface 98. The slots 104 extend generally parallel with the transverse conveyor 86 and the tines 82. When the elevator assembly 66 occupies its lowermost position (FIGS. 3 and 4), the tines 82 are received within the slots 104, and the U-shaped portions 84 of the elevator frame member 68 are in non-contacting and close adjacency with the support surface 98, and the plane defined by the upper surface of the tines 82 is slightly below the plane of the upper support surface 98. Thus, the transverse conveyor 86 is capable of moving the container 94, with respect to the elevator assembly 66 in its lowermost position, provided stacks 14 in the compartments 100 to do interfere with the movement. The U-shaped portions 84 of the elevator frame member 68 are in non-contacting relation with the partitioning elements 102 during movement of the container by the transverse conveyor. The partitioning elements do not extend vertically upward a sufficient distance to interfere with elements of the intermediate conveyor.

Sensor means such as position sensing switches (not shown) are operatively connected to the apparatus 10 and sense the position of the rows of compartments 100 of the container 94. The sensor means control the transverse conveyor drive means 93 to move or index each row of compartments into position vertically below the intermediate conveying path when the intermediate conveyor 28 occupies the projected position.

A suitable control arrangement or means (not shown) is utilized in conjunction with the apparatus 10. The control means is operatively connected with the sensor means previously described for the purpose of controlling operation of the apparatus 10. The control means thus controls the effects achieved by the pacer 18, the motor and drive means 40, 42, and 44 for the conveyor segments 34, 36, and 38 respectively, the hydraulic assembly 50 for moving the intermediate conveyor between its retracted and projected positions, the hydraulic assemblies 58 and 64 for respectively moving the separator plates 54 and 60 between the retracted and extended positions, the motor and drive means 74 for moving the elevator assembly 66 between its lower and upper positions, and the conveyor drive means 93 for moving the transverse conveyor to position rows of compartments vertically in alignment with the intermediate conveying path. From the previous structural description and following description of operation, the arrangement and elements of the control means will be apparent to one having ordinary skill in this art.

Operation

The article handling apparatus 10 is capable of receiving articles or stacks 14 of newspapers in randomly spaced and serial order from the first conveyor 12, arranging a predetermined number of the articles in a predetermined linear spaced apart relationship corresponding to the spacing of the compartments 100 of the container 94, and loading or depositing the arranged articles in the rows of compartments in the container. Once the container is filled with articles, the transverse conveyor 86 moves the filled container on to a place where the container is stored or otherwise utilized. Also, the article handling apparatus 10 is further capable of reverse operation for unloading articles contained within compartments of the container and depositing those articles on a single conveyor is spaced apart single file serial order. The article loading operation involves a series of events which generally occur in reverse of the series of events which define the article unloading operation. Both types of operation are described in detail below.

A. Article Loading

To receive articles in randomly spaced serial order and deposit the articles in rows of compartments in the container, the following series of events occur.

Starting Condition.

The starting or beginning position for the operation as generally illustrated in FIG. 1. In the starting position, (a) the intermediate conveyor 28 is moved to its retracted position; (b) the separator plates 54 and 60 are moved to their retracted positions; (c) the container is indexed or moved until the first or the next unempty row of compartments is in position to be vertically aligned with the intermediate conveying path when the intermediate conveyor is thereafter moved to the projected position; (d) the elevator assembly 66 is positioned at its lower position; and (e) the pacer 18 is holding the first stack 14 and a potentially number of other stacks 14 following the restrained stack.

Event One.

Figure 5:
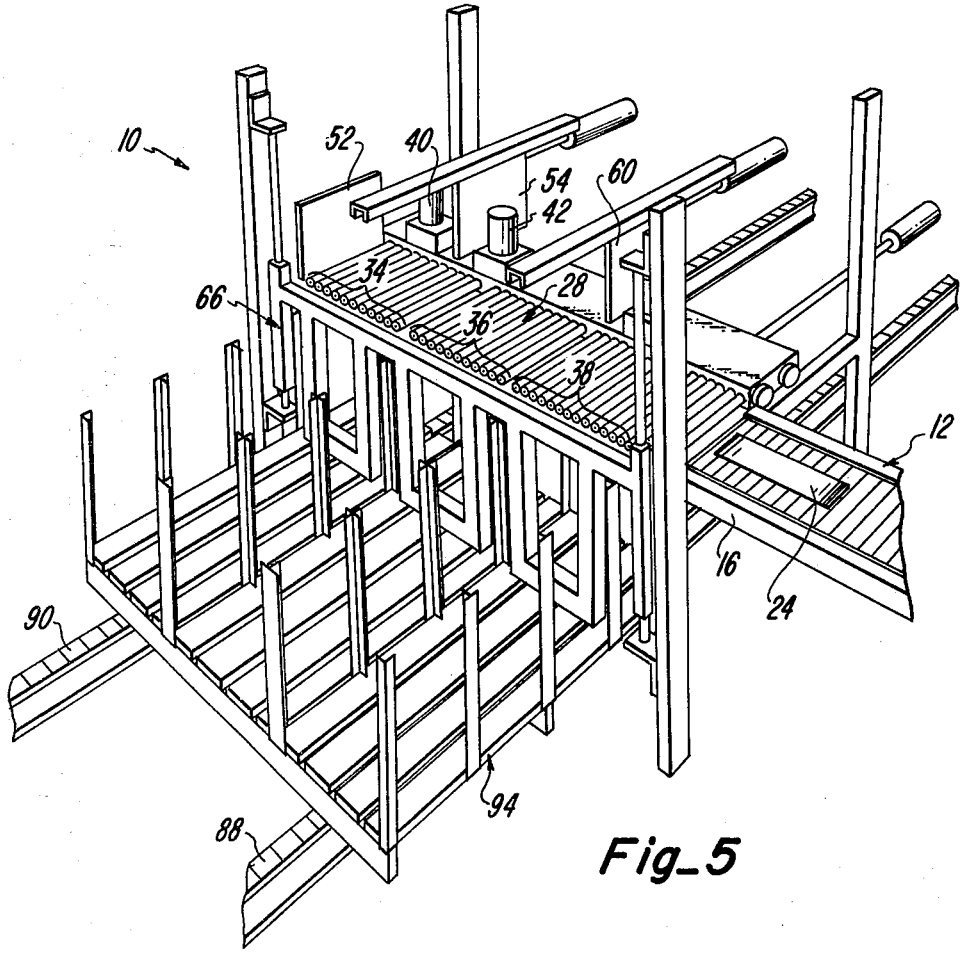
FIGS. 5 to 8 are generalized views similar to FIG. 1 in which events in the sequence of operation are illustrated.

The first event of the operation involves (a) moving the intermediate conveyor 28 to its projected position in which the intermediate conveying path is in alignment with the terminal end 16 of the first conveyor 12; and (b) the conveyor rolls of the conveyor segments 34, 36, and 38 are rotated by operation of the motor and drive means 40, 42, and 44 respectively. FIG. 5 illustrates this condition. In this operational event the intermediate conveying path is aligned to receive articles from the terminal end of the first conveyor and is also operative to conduct or move articles thereover.

Event Two.

After the intermediate conveyor attains its projected position, the pacer 18 releases the first stack 14 and holds the remainder of the accumulated stacks. The first stack encounters the speed-up conveyor 24 and is accelerated to the conveying speed of the intermediate conveying path. The first stack traverses the initial conveying segment 38, the middle conveying segment 36 and the terminal conveying segment 34. Movement of the first stack terminates when the stack contacts and is restrained by the end plate 52 of the intermediate conveyor.

Event Three.

When the sensor means associated with the end plate 52 senses the first stack, (a) the movement of the conveyor rolls of the terminal conveyor segment 34 is terminated by terminating the operation of the motor and drive means 40; and (b) the separator plate 54 is moved from its retracted to its extended position. The separator plate 54 is freely movable since the length of each stack 14 is slightly less than the longitudinal length of each conveyor segment. In its extended position the separator plate 54 blocks the conveying path at the terminal end of conveyor segment 56.

Event Four.

Figure 6:
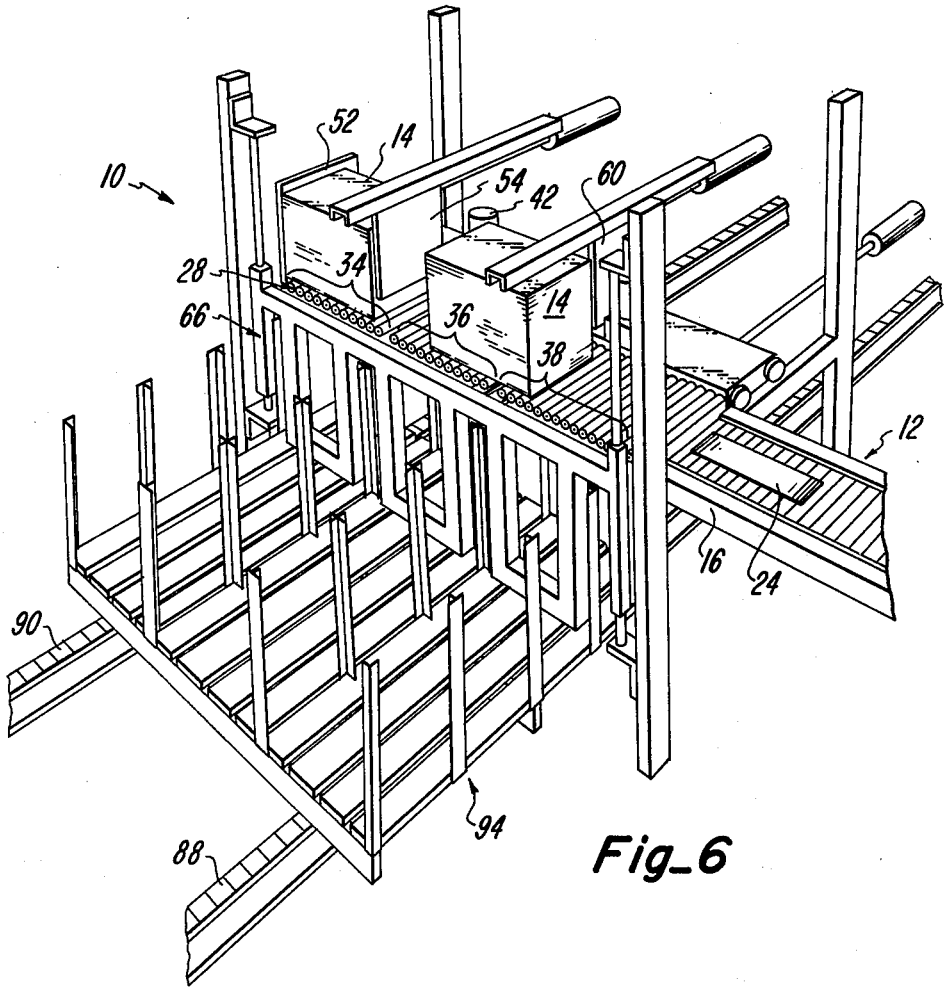

After the separator plate 54 attains its extended position, the pacer releases the second stack and holds the remainder of the stacks. The second stack encounters the speed-up conveyor and is conveyed over the initial and middle conveyor segments 38 and 36, as shown in FIG. 6. The second stack contacts and is restrained by the separator plate 54.

Event Five.

When the sensor means associated with the separator plate 54 senses contact by the second article, (a) rotation of the conveyor rolls of the middle conveyor segment 36 is terminated by terminating operation of the motor and drive means 42, and (b) the separator plate 60 is moved from its retracted to its extended position.

Event Six.

After the separator plate 60 attains its extended position the pacer releases the third stack and holds the remainder of the stacks. The third stack encounters the speed-up conveyor 24 and is conveyed on to the initial conveyor segment 38. The third stack contacts and is restrained by the extended separator plate 60.

Event Seven.

When the sensor means associated with the separator plate 60 senses contact by the third stack, (a) rotation of the conveyor rolls on the initial conveyor segment 38 is terminated by terminating operation of the motor and drive means 44, and (b) the elevator assembly 66 is moved from its lower position to its upper position. The tines are vertically aligned with the spaces between the conveyor rolls and move freely upward. In the uppermost position, the tines lift the three articles from the intermediate conveying path, because the support plane defined by the tines is above the conveying plane of the intermediate conveying path.

Event Eight.

Upon the elevator assembly attaining its uppermost position, thus lifting the articles from the intermediate conveying path, (a) the intermediate conveyor 28 moves to its retracted position, and (b) the seperator plates 54 and 60 move to their retracted positions. At the end of this sequence shown in FIG. 7, the three stacks are held on the tines 82 of the elevator assembly in the same predetermined spaced apart relationship previously obtained on the intermediate conveying path by operation of the plate members 52, 54 and 60. The intermediate conveyor 28 has moved to the retracted position in which the conveyor rolls will not interfere with vertical movement of the stacks held by the elevator assembly. Thus the stacks can be moved in uninhibited vertical motion by the elevator assembly.

Event Nine.

Figure 8:
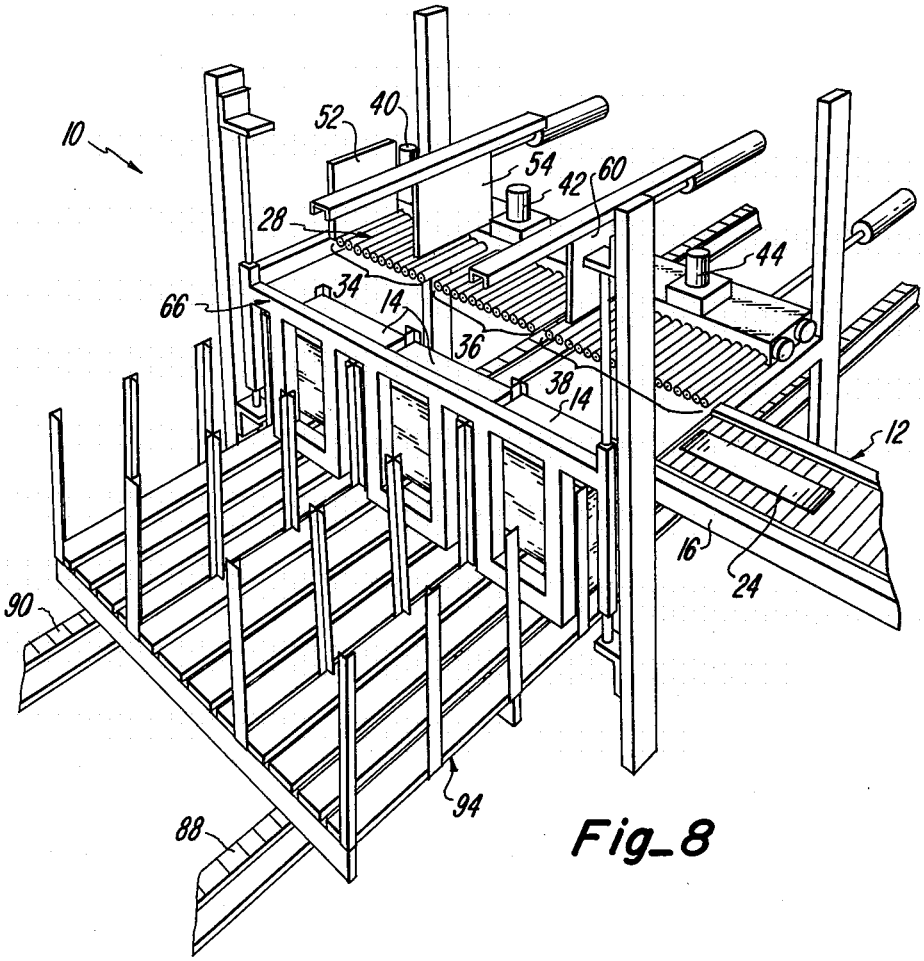

Upon the intermediate conveyor attaining its retracted position the elevator assembly moves vertically downward to deposit the articles in the row of compartments vertically aligned therebelow as is shown in FIG. 8. At the lowermost position of the elevator assembly 66, the tines fit within the slots 104 in the supporting surface 98. The support plane defined by the tine members moves below the support surface 98 of the container, thus assuring that the articles are deposited on the container support surface. In its lowermost position, the tines and other elements of the elevator assembly are in non-contacting and non-interfering relationship with the elements of the container.

Event Ten.

After deposit of the stacks in the container compartments 100 and the attainment of the lowermost position of the elevator assembly 66, the transverse conveyor drive means 93 indexes or advances the chains 88 and 90 to position the next row of container compartments in position to receive articles. The sensor means associated with the transverse conveyor supplies a signal indicating the correct position of the next row of compartments.

At the termination of the events described, the basic elements of the apparatus 10 are in the starting condition described previously. The sequence of events is repeated until each row of compartments in the container has been filled with articles. After all the compartments of the container have been filled, the transverse conveyor moves the filled container on and aligns the next container with its row of compartments in proper position for receiving articles.

It is apparent from the foregoing description that the intermediate conveyor 28 serves as means for receiving a plurality of articles on the intermediate conveying path in predetermined linear spaced apart relationship. This space between articles is controlled by the plate members 52, 54, and 60, and the predetermined relationship assures that the articles are correctly spaced be received in the compartments 100. During movement by the elevator assembly, the spaced apart relationship of the articles is maintained.

B. Article Unloading

To unload articles from the container 94, and transfer those unloaded articles into a single file spaced apart relationship on the first conveyor 12, the foregoing operations are basically reversed. Of course, the direction of movement of all of the conveyors is reversed. As will become apparent, the separator plates 54 and 60 are not used, but are maintained during the unloading operation in their retracted positions. The pacer 18 is also not used and its plates 20 and 22 are maintained as the maximum outward transverse position to avoid interfering with the passage of articles past the pacer.

Starting Conditions.

With the exceptions noted, the starting condition occurs with (a) the intermediate conveyor 28 moved to its retracted position and (b) the elevator assembly moved to its lower position.

Event One.

The transverse conveyor drive indexes the conveyor from right to left, as shown in FIG. 1, so that the tines 82 extend into the slots 104 and the first row of stacks to be unloaded is in vertical alignment for the unloading operation. The unloading position is sensed by the sensor means associated with the transverse conveyor 86. The container is freely movable with respect to the elevator assembly in its lowermost position since the support surface of the tines 82 is below the support surface 98 of the container.

Event Two.

Figure 7:
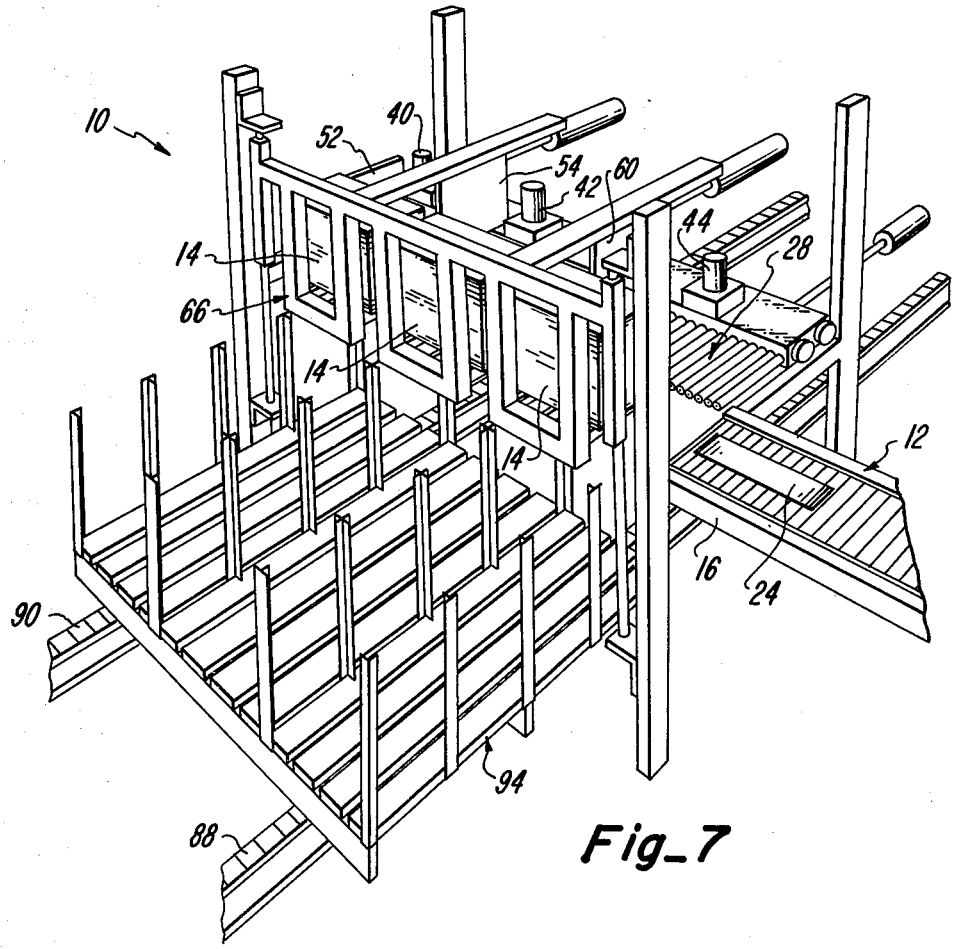

Upon attaining the vertical aligned position, the elevator assembly moves vertically upward to its uppermost position, as shown in FIG. 7. The tines contact the stacks 14 and lift them from the container support surface 98 to the uppermost position where the stacks are slightly above the conveying plane of the intermediate conveying path.

Event Three.

When the elevator assembly attains its uppermost position, the intermediate conveyor is moved to its projected position in which the conveyor rolls defining the intermediate conveying path are vertically beneath stacks supported on the tines.

Event Four.

Upon the intermediate conveyor attaining the projected position, the elevator assembly 66 moves from the uppermost position of the lowermost position. During downward movement the articles are deposited on the intermediate conveying path.

Event Five.

Upon the elevator assembly 66 attaining its lowermost position with the intermediate conveyor in the projected position, the motor and drive means associated with the three conveyor segments are either simultaneously activated to convey all the articles deposited on the intermediate conveying path to the end 16 of the first conveyor, or the conveyor segments are activated sequentially, the initial conveyor 38 being first activated, followed by the middle conveying segment 36 and the terminal conveying segment 34. With the exception of the separator plate being shown its extended position, which does not occur during article unloading, FIG. 6 illustrates this event.

Event Six.

After the predetermined number of stacks from one row of the container are conveyed off of the intermediate conveying path onto the first conveyor, the intermediate conveyor is moved to its retracted position.

After the intermediate conveyor has been moved to the retracted position, the elements are in the starting condition described above. The series of events described for unloading the container are thus repeated until all the articles from the container have been unloaded.

Significant advantages and benefits result from the nature and operation of the article handling apparatus 10. The articles or stacks 14 can be quickly deposited onto containers, and the loaded containers can be conveniently transported or stored until it is desired to use the articles. The apparatus is further capable of reverse operation in which the articles can be quickly unloaded from the container for use. Both the loading and unloading operations are completely automated. The invention embodied in the article handling apparatus 10 provides significant advantages and advancements in the art, as is apparent to one comprehending the significance of the invention.

The preferred embodiment of the present invention has been described with a degree of particularity. It should be understood, however, that the degree of specificity is not intended to restrict the spirit and scope of the invention or unnecessarily restrict the definition of the invention in the appended claims.

What is claimed is:

1. Article handling apparatus, comprising in combination:

first means for delivering a predetermined plurality of articles in a spaced apart serial manner;

second means operatively arranged for receiving the predetermined plurality of articles delivered from said first means, said second means including means for separating each of said articles into a predetermined spaced apart linear configuration with adjacent articles in the linear configuration being spaced at predetermined intervals, said second means defining an intermediate conveying path upon which the articles are received and separated;

third means for simultaneously transferring the predetermined plurality of articles from the intermediate conveying path while maintaining the predetermined linear configuration, said third means further vertically moving the predetermined linear configuration of articles with respect to the intermediate conveying path;

a container including means defining a generally planar article supporting surface and means for partitioning said container into at least one linear row of spaced apart compartments, each row being formed of a plurality of linearly aligned compartments, the number of comparments in each row being at least equal to the predetermined plurality of articles in the predetermined linear configuration, the partitioning means further spacing adjacent compartments in each row at approximately the same intervals at which adjacent articles are spaced in the predetermined linear configuration;

fourth means for operatively positioning said container with the compartments of one row in parallel alignment with predetermined linear configuration of articles during at least a portion of the movement of the articles by said third means; and said third means further transferring all of the articles in the predetermined linear configuration into the row of compartments of the container with one article being received in each compartment of the row.

2. Apparatus as recited in claim 1 wherein:

said container is positioned by said fourth means with compartments in the rows substantially vertically spaced with respect to the intermediate conveyor path, and said third means moves the predetermined linear configuration of articles substantially vertically between the intermediate conveying path and the row of compartments.

3. Apparatus as recited in claim 1 wherein:

said container includes a plurality of linear rows of compartments, and said fourth means successively positions each row of compartments to receive the articles deposited by said third means.

4. Apparatus as recited in claims 1 or 3 wherein:

said second means is operatively movable to a first position at which the intermediate conveying path is in alignment to receive articles delivered from said first means and is further operatively movable to a second position at which said intermediate conveying path is out of alignment to receive articles delivered from said first means and is further in non-interfering relation with the predetermined linear configuration of articles moved by said third means.

5. Apparatus as recited in claim 4 further comprising:

fifth means operatively connected for moving said second means from its first position to its second position after said third means has transferred the predetermined linear configuration of articles from the intermediate conveying path and prior to said third means transferring the predetermined linear configuration of articles into the compartments of said container.

6. Apparatus as recited in claim 5 wherein:

said container is positioned by said fourth means with the compartments in the row substantially vertically spaced with respect to the intermediate conveying path, and said third means moves the predetermined linear configuration of articles substantially vertically between the intermediate conveying path and the row of compartments.

7. Apparatus as recited in claim 4 wherein:

the separator means of said second means comprises at least one separator plate selectively operable to restrain movement of an article over the intermediate conveying path.

8. Apparatus as recited in claim 7 wherein:

said second means comprises a plurality of conveyor segments, the plurality of conveyor segments being equal in number to the predetermined plurality of articles received by said second means, the plurality of conveyor segments being arranged in serial order to thereby define the intermediate conveying path, and each conveyor segment adapted to receive one article thereon.

9. Apparatus as recited in claim 8 wherein:

each conveyor segment includes a plurality of spaced apart conveyor rolls; and said third means includes a plurality of tine members operatively connected for movement into the spaces between at least a few of the conveyor rolls.

10. Apparatus as recited in claim 9 wherein:

said container further includes means defining slots in the supporting surface, the slots extending essentially transversely of each row, the slots being adapted to receive the tine members of said third means therein.

11. An invention as defined in claim 5 wherein:

said apparatus is capable of reverse operation in which articles previously within the compartments of said containers can be removed and delivered as a series of single file articles at said first means.

12. Apparatus for handling articles delivered from and carried by a first conveyor, comprising in combination:

aligning and spacing means operatively connected for delivering a predetermined plurality of articles in a spaced apart linear configuration by retaining and releasing articles carried by said first conveyor;

an intermediate conveyor operatively connected to receive articles released by said aligning and spacing means, said intermediate conveyor defining an intermediate conveying path of length sufficient to receive thereon the predetermined plurality of articles in a predetermined spaced apart linear configuration, said intermediate conveyor further being operatively positionable and transferable between a projected position at which to receive the articles released by said aligning and spacing means and between a retracted position at which not to receive articles released by said aligning and conveying means;

transfer means for transferring the plurality of articles in the predetermined linear configuration from said intermediate conveyor, said transfer means including means for contacting and supporting each article during transfer from said intermediate conveyor, said contacting and supporting means being essentially movable between a first position at which said articles are removed from said intermediate conveyor and between an unload position vertically spaced from the first position;

a container including means defining a generally planar article supporting surface and including means for partitioning the article supporting surface into at least one linear row of spaced apart compartments, each row being formed of a plurality of compartments, the number of compartments in each row being no less than the predetermined plurality of articles in the predetermined linear configuration, said partitioning means further spacing adjacent compartments in each row at intervals corresponding to the intervals between adjacent articles in the predetermined linear configuration;

a transverse conveyor operatively connected to carry and move said container thereon with each row of compartments in parallel alignment with the predetermined linear configuration of articles received on said intermediate conveyor, said transverse conveyor also positioning the article supporting surface of said compartment in vertical spaced relation with said intermediate conveyor;

means for moving said transverse conveyor to position each row of compartments to receive the predetermined configuration of articles therein upon movement of the contacting and supporting means to its unload position;

means, responsive to the predetermined configuration of articles being completely received on said intermediate conveyor, for activating said contacting and supporting means to move vertically to its first position, thereby transferring articles from said intermediate conveyor;

means, responsive to the contacting and supporting means attaining its first position, for moving said intermediate conveyor from its projected position to its retracted position;

means, responsive to said intermediate conveyor attaining its retracted position, for moving the contacting and supporting means to its unload position; and means, responsive to the contacting and supporting means attaining its unload position, for moving said transverse conveyor.

13. Apparatus as rectied in claim 12 wherein:

said intermediate conveyor comprises a plurality of conveyor segments, the plurality of conveyor segments being equal in number to the predetermined plurality of articles in the predetermined configuration, the plurality of conveyor segments being arranged in serial order to thereby define an intermediate conveying path of said intermediate conveyor, and each conveying segment being of size to receive one article thereon.

14. Apparatus as recited in claim 13 further comprising:

separator means positioned relative to each conveyor segment for restraining movement of one article on each conveyor.

15. Apparatus as recited in claim 14 wherein:

said separator means comprises a plurality of plate members positioned at one end of each conveyor segment, at least one of said plate members being operatively connected for transverse reciprocating movement between an extended position blocking the intermediate conveying path and between a retracted position allowing free movement of articles along the intermediate conveying path.

16. Apparatus as recited in claim 15 further comprising:

activating means, operatively connected to each transversely movable plate member, for moving one plate member from the retracted position to the extended position upon another plate member operatively terminating movement of an article on a conveyor segment.

17. Apparatus as recited in claim 16 further comprising:

means, responsive to the last plate member attaining the extended position, for temporarily terminating operation of said aligning and spacing means and for initiating movement of said contacting and supporting means vertically to its first position.

18. Apparatus as recited in claim 17 further comprising:

means for separately operating each conveyor segment, and means, responsive to an article on one conveyor segment being restrained by a plate member, for terminating operation of said segment operating means.

19. Apparatus as recited in claim 17 wherein:

each conveyor segment includes a plurality of spaced apart conveyor rolls, and said article transfer means including a plurality of tine members operatively connected for movement in spaces between at least a few of the conveyor rolls.

20. Apparatus as recited in claim 19 wherein:

said container further includes means defining slots adjacent the supporting surface, the slots extending transversely of each row of compartments, said slots being adapted to receive the tine members therein.

21. Apparatus as recited in claims 12 or 20:

wherein said container comprises a plurality of parallel rows of compartments; and further comprising means, responsive to the contacting and supporting means of said article transfer means attaining the unload position, for moving said transverse conveyor an amount to index a different row of compartments into position for receiving articles therein.

22. Apparatus useable with a container and capable of receiving articles in randomly spaced serial order and depositing the articles in compartments of the container, and further being capable of removing articles from compartments of the container and delivering the articles removed in serial single file order; said apparatus being adapted to be used in conjunction with a first conveyor selectively reversably; operable to deliver articles to said apparatus and to remove articles from said apparatus; said container comprising a planar surface to support articles deposited thereon and means defining a plurality of parallel linear rows of compartments on the support surface, each row including the same predetermined number of compartments, each compartment being of predetermined size and configuration to receive one article therein, adjoining compartments of each row being spaced at predetermined intervals; said apparatus comprising, in combination:

an intermediate conveyor defining a linear intermediate conveying path selectively reversably operable to receive thereon a predetermined number of articles from said first conveyor and to deliver the predetermined number of articles to said first conveyor, said intermediate conveyor comprising a plurality of linearly aligned segments of spaced apart rolls, each conveyor segment adapted to support one article thereon, said conveyor rolls being cantilever connected from one end thereof, said intermediate conveyor further comprising conveyor roll drive means operatively connected for independently rotating the conveyor rolls of each segment, and an end plate positioned at the end of the intermediate conveying path opposite the end at which articles are received from and delivered to said first conveyor;

at least one separator plate operatively connected to extend intermediate at least one pair of adjacent conveyor segments of the intermediate conveying path thereby blocking the intermediate conveying path to the movement of articles thereover and further operatively connected to retract thereby clearing the intermediate conveying path to the movement of articles thereover;

activating means connected for independently moving each separator plate between its extended and retracted positions;

said separator and end plates being positioned to restrain articles on the intermediate conveying path at the same predetermined intervals as the intervals between compartments in each row of the container;

means operatively connected for horizontally moving said intermediate conveyor between a projected position and a retracted position, the projected position positioning the conveyor rolls in alignment to receive articles from and deliver articles to said first conveyor, the retracted position being displaced from the projected position;

an elevator positioned relative to said intermediate conveyor, said elevator comprising a vertically movable frame member and a plurality of tines extending horizontally from the frame member in a configuration to generally define a support plane and at positions in vertical alignment with at least some of the spaces between adjacent conveyor rolls in each conveyor segment of said intermediate conveyor, the horizontal extent of each tine being sufficient to encompass a majority of the transverse width of the intermediate conveying path, and also comprising means operatively connected for moving the the frame vertically between an upper position at which the the horizontal plane defined by the tines is elevated above the intermediate conveying path and between a lower position at which the support plane defined by the tines is vertically below the intermediate conveying path;

a transverse conveyor extending transversely with respect to the intermediate conveying path, said transverse conveyor adapted to carry at least one container in a predetermined manner in which each row of compartments is in parallel alignment with the intermediate conveying path, said transverse conveyor being positioned below said intermediate conveyor at a predetermined position at which support surface of said container is elevated above the horizontal plane defined by the tines when the frame of said elevator is in its lower position, and means for moving said transverse conveyor to position one row of compartments of a container vertically below the intermediate conveyor path.

* * * * *